US008163230B2

(12) United States Patent
Rinker et al.

(10) Patent No.: US 8,163,230 B2
(45) Date of Patent: Apr. 24, 2012

(54) ROTARY HEARTH FURNACE FOR TREATING METAL OXIDE MATERIALS

(75) Inventors: Franklin G. Rinker, Naples, FL (US); Daniel A. Molnar, Perrysburg, OH (US)

(73) Assignee: Global Research and Engineering, LLC, Perrysburg, OH (US)

( * ) Notice: Subject to any disclaimer, the term of this patent is extended or adjusted under 35 U.S.C. 154(b) by 678 days.

(21) Appl. No.: 12/201,653

(22) Filed: Aug. 29, 2008

(65) Prior Publication Data

US 2010/0052226 A1 Mar. 4, 2010

(51) Int. Cl.
*F27B 7/22* (2006.01)

(52) U.S. Cl. ..... 266/173; 266/176; 75/474; 75/477; 432/138; 432/250

(58) Field of Classification Search ..... 266/173; 432/247, 248, 249, 250, 251, 252, 138, 27; 75/474, 477, 487
See application file for complete search history.

(56) References Cited

U.S. PATENT DOCUMENTS

| | | | | | |
|---|---|---|---|---|---|
| 2,879,051 | A * | 3/1959 | Buckholdt | 432/76 |
| 3,912,501 | A * | 10/1975 | De Castejon | 75/10.34 |
| 3,988,012 | A * | 10/1976 | Jemal | 266/179 |
| 4,111,644 | A * | 9/1978 | Buckholdt | 432/179 |
| 4,203,761 | A * | 5/1980 | Rose | 75/499 |
| 4,758,268 | A * | 7/1988 | Bishop et al. | 266/145 |
| 5,601,631 | A | 2/1997 | Rinker et al. | |
| 5,660,542 | A | 8/1997 | Rinker et al. | |
| 5,782,957 | A | 7/1998 | Rinker et al. | |
| 5,865,875 | A | 2/1999 | Rinker et al. | |
| 5,873,925 | A | 2/1999 | Rinker et al. | |
| 5,895,215 | A | 4/1999 | Rinker et al. | |
| 5,924,861 | A | 7/1999 | Rinker et al. | |
| 6,152,729 | A | 11/2000 | Rinker et al. | |
| 6,182,817 | B1 | 2/2001 | Rinker et al. | |
| 6,270,551 | B1 | 8/2001 | Rinker et al. | |
| 6,390,810 | B1 * | 5/2002 | Rinker et al. | 432/138 |
| 6,395,060 | B1 | 5/2002 | Horne et al. | |
| 6,406,662 | B1 | 6/2002 | Molnar et al. | |
| 6,464,753 | B2 | 10/2002 | Horne et al. | |
| 6,508,856 | B1 | 1/2003 | Rinker | |
| 6,572,675 | B2 * | 6/2003 | Yerushalmi | 75/585 |

* cited by examiner

*Primary Examiner* — Scott Kastler
*Assistant Examiner* — Michael Aboagye
(74) *Attorney, Agent, or Firm* — MacMillan, Sobanski & Todd, LLC

(57) ABSTRACT

A rotary hearth furnace for treating metal oxide materials comprises a hearth mounted for rotary movement within an enclosure. One or more fuel burners are positioned above the hearth. The burners are operably fired to heat the furnace so that heat radiates toward the hearth. One or more oxygen nozzles are positioned between the hearth and the burners in a manner that avoids substantial contact between the oxygen and the briquettes, thereby creating a quiescent zone immediately above the briquettes, with the quiescent zone being sufficient to minimize reoxidation of the reduced briquettes, and minimize entrainment of particulate matter from the briquettes.

21 Claims, 2 Drawing Sheets

ROTARY HEARTH FURNACE FOR TREATING METAL OXIDE MATERIALS

TECHNICAL FIELD

This invention is generally related to an apparatus for the thermal improvement of treating metal oxide materials. More particularly, this invention relates to a rotary hearth furnace heating apparatus for treating metal oxide materials such as metal oxide ores or fines for such purposes as recovering elemental iron and other metallic substances from iron-bearing materials and other metal oxide materials.

BACKGROUND OF THE INVENTION

Steel making processes employing either a blast furnace, basic oxygen furnace or an electric arc furnace typically use large amounts of refined ore and recycle steel scrap. The waste produced during the refining and melting includes fines and dust containing oxides of iron as well as other materials.

Furnace dust containing high levels of lead, zinc and cadmium oxides has been declared hazardous and must be collected and reprocessed in order to protect the environment. Because of the presence of lead, zinc and cadmium oxides, as well as other materials, attempts to reclaim the iron oxides directly for reuse have not proved to be practical. Various alternatives to the direct recovery of the iron oxides have been proposed. One such proposal is to agglomerate moist dust to form briquettes or pellets and then subject the briquettes to a very high temperature to reduce the iron oxides so that the metal can be recovered for the steel making process. In some situations, raw ore containing metal oxides such as titanium or zinc are subjected to a reduction process to recover various constituents of the ore.

SUMMARY OF THE INVENTION

This invention relates to a furnace for treating metal oxide materials. The furnace comprises a hearth mounted for rotary movement within an enclosure. One or more primary fuel burners are positioned above the hearth, within the enclosure. The primary burners are operably fired to heat the furnace so that heat radiates toward the furnace roof and sidewalls and to the hearth. In one embodiment, one or more oxygen nozzles are positioned vertically between the hearth and the burners so that oxygen flowing from the nozzles can combust carbon monoxide and other gases emanating from the heated metal oxide material. In one embodiment, the oxygen is introduced in a manner that minimizes turbulence, thereby enabling a quiescent zone immediately above the metal oxide material. In one embodiment the quiescent zone consists mainly of off-gassed carbon monoxide.

In one embodiment the rotary hearth furnace for treating metal oxide materials includes an annular enclosure having a roof and spaced apart inner and outer circular sidewalls, and an annular hearth for supporting metal oxide materials to be treated, the hearth being mounted for rotary movement within the enclosure, the enclosure and the hearth being formed of a refractory material. One or more primary fuel burners are positioned above the hearth, the burners being capable of being fired to discharge combusted gases into the furnace, thereby heating the furnace walls, roof and hearth, whereby the furnace walls and roof are capable of radiating heat to the metal oxide materials on the hearth. One or more oxygen nozzles positioned above the hearth, the oxygen nozzles being positioned so that oxygen flowing from the nozzles combines with gases evolving from the metal oxide material, where the oxygen nozzles are positioned high enough above the hearth to avoid substantial contact between the oxygen and the metal oxide material, thereby creating a quiescent zone immediately above the metal oxide material, with the quiescent zone being sufficient to minimize entrainment of particulate matter from the metal oxide material.

In one embodiment the rotary hearth furnace for treating metal oxide materials includes an annular enclosure having a roof and spaced apart inner and outer circular sidewalls. An annular hearth for supporting metal oxide materials to be treated is mounted for rotary movement within the enclosure, the enclosure and the hearth being formed of a refractory material, the roof of the enclosure being positioned at a first height above the hearth. One or more primary fuel burners are positioned at a second height above the hearth, wherein the second height is below the first height. The burners are capable of being fired to discharge combusted gases into the furnace, thereby heating the furnace walls, roof and hearth, whereby the furnace walls and roof are capable of radiating heat to the metal oxide materials on the hearth. One or more oxygen nozzles are positioned at a third height above the hearth wherein the third height is below the second height, with the nozzles being positioned so that oxygen flowing from the nozzles combines with gases evolving from the metal oxide material. The oxygen nozzles are positioned high enough above the hearth to avoid substantial contact between the oxygen and the metal oxide material, thereby creating a quiescent zone immediately around and above the metal oxide material. The quiescent zone is sufficient to minimize entrainment of particulate matter from the metal oxide material on the hearth.

In one embodiment the rotary hearth furnace for treating metal oxide materials includes an annular enclosure having a roof and spaced apart inner and outer circular sidewalls. An annular hearth for supporting metal oxide materials to be treated is mounted for rotary movement within the enclosure, the enclosure and the hearth being formed of a refractory material, the roof of the enclosure being positioned at a first height above the hearth. One or more primary fuel burners are positioned at a second height above the hearth, wherein the second height is below the first height. The burners are capable of being fired to discharge combusted gases into the furnace, thereby heating the furnace walls, roof and hearth, whereby the furnace walls and roof are capable of radiating heat to the metal oxide materials on the hearth. One or more oxygen nozzles are positioned at a third height above the hearth wherein the third height is below the second height, with the nozzles being positioned so that oxygen flowing from the nozzles combines with gases evolving from the metal oxide material. The oxygen nozzles are positioned high enough above the hearth to avoid substantial contact between the oxygen and the metal oxide material, thereby creating a quiescent zone immediately above the metal oxide material. The quiescent zone is sufficient to minimize entrainment of particulate matter from the metal oxide material. The oxygen nozzles emit oxygen at a pressure sufficiently low to ensure substantial combustion of the evolved gases without generating turbulence contacting the metal oxide material, thereby enabling a quiescent zone to be maintained immediately above the metal oxide material.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
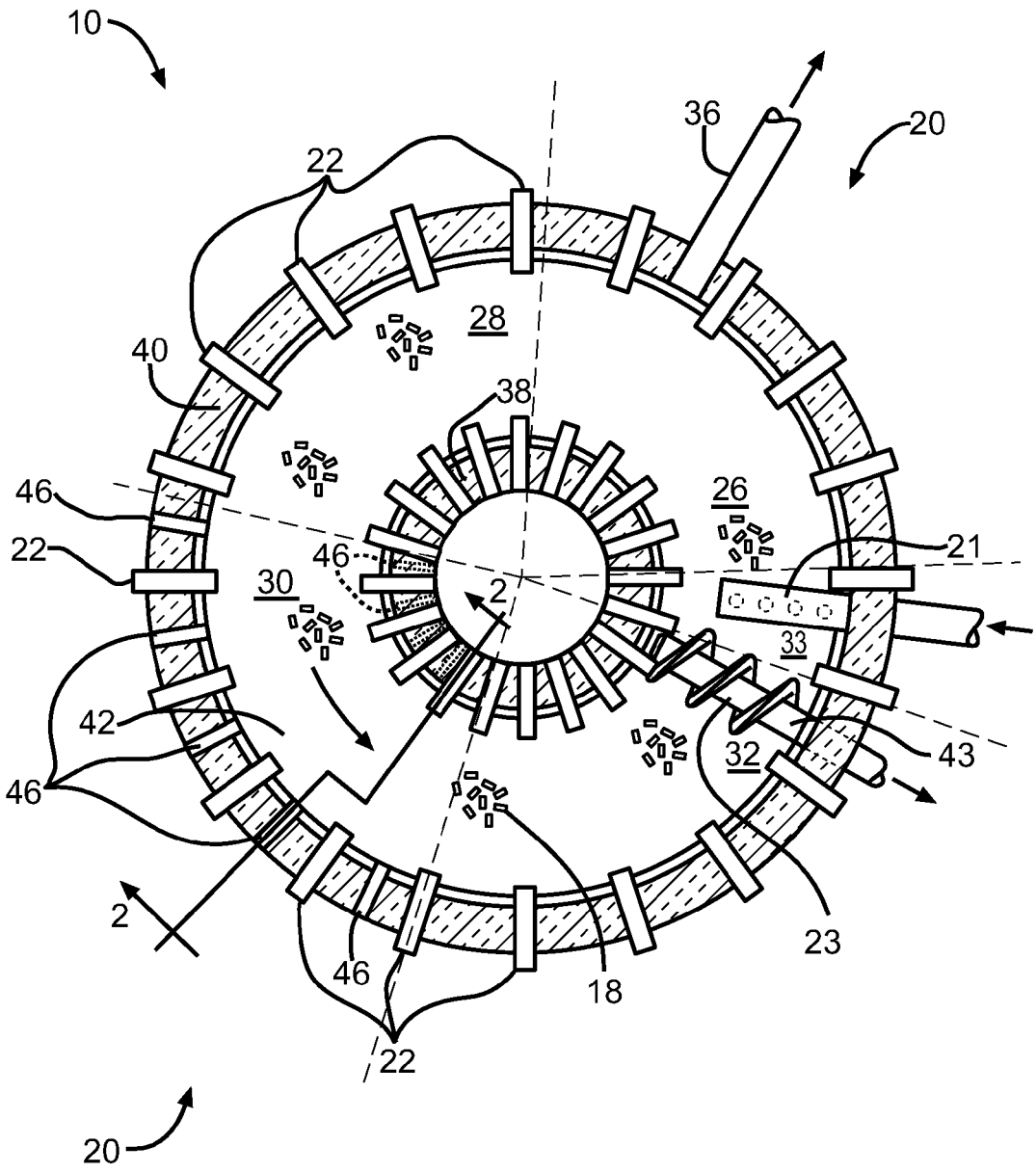
FIG. 1 is a plan view of a rotary hearth furnace.

Referring now to the drawings, wherein like reference characters represent like elements, there is shown in FIG. 1 a rotary hearth furnace 10 for treating metal oxide materials such as ores and fines. It should be noted that for purposes of clarity certain details of construction of the apparatus for practicing the process of treating metal oxide materials are not provided in view of such details being conventional and well within the skill of the art once the apparatus is disclosed and explained. For example, blowers, piping and conveyors and the like as required for the handling of gaseous and particulate solid materials may be any such known commercially available components with the exception that such components may be modified as necessary by one skilled in the art to be employed in the overall system as discussed herein.

In this specification the process and apparatus are primarily described in connection with treating metal oxide materials to recover elemental iron from iron-bearing materials such as steel mill waste, basic oxygen furnace dust, rolling mill scale, or the like, collected as a result of normal steel making operations. It is to be understood that the process and apparatus may also be used with equal facility or benefit for treating metal oxide materials containing non-iron metals, such as, for example, oxides of titanium, lead, chromium, vanadium and zinc. These metal oxides can be processed from ore materials mined from the earth, as well as from materials generated in other processes such as steel making processes. In another example, the process and apparatus can be used to recover elemental cobalt and nickel from cobalt or nickel-bearing material such as cobalt or nickel-bearing ores, including cobalt and nickel oxides. Accordingly, the description of the embodiments in this specification in relation to steel mill waste, basic oxygen furnace dust, rolling mill scale or the like is not to be construed as a limitation on the scope of the claims.

Iron-bearing material such as ore fines, steel mill waste, basic oxygen furnace dust, rolling mill scale, or the like, may be collected as a result of normal steel making operations. The various types of iron-bearing material may contain metal oxides and fixed carbon. Depending upon the content of fixed carbon within the iron-bearing material carbonaceous material may be required. For example, steel mill waste may contain sufficient fixed carbon whereas ore fines may require the addition of surplus fixed carbon. The carbonaceous material may be any suitable material including a coke, coke breeze or a bituminous coal. The carbonaceous material may function as a reductant for the metal oxides. Part of the carbonaceous material may be off-gassed when treating metal oxide materials and part of the carbonaceous material may be in the finished product. A desired amount of carbonaceous material may be left in the finished product for converting the finished product to steel.

The iron-bearing material and carbonaceous material may be thoroughly blended to form a mixture in a mixer of a type well known in the art. The mixture of iron-bearing material and carbonaceous material may then be agglomerated with a binder to form briquettes 18. Several types of well known binders may be used including for example organic binders such as molasses, coal tar pitch, humic acid and the like. It may be further appreciated that the organic binder may also serve as a source of carbon for the reaction. The iron bearing material may also be introduced in the form of pellets or in the form of a ground up combination of the ore and carbonaceous material. For purposes of this specification, it is to be understood that the term "briquettes" includes not only conventional briquettes fed into the rotary hearth furnace 10, but also other forms of the metal oxide material to be reduced, including pellets and ground up material.

The briquettes 18 may be uniformly distributed onto a hearth 42 of the rotary hearth furnace 10. The briquettes 18 may be distributed onto the hearth by any suitable feeder such as an electric vibratory feeder, conveyor or other uniformly distributing device. The hearth 42 of the rotary furnace 10 may be in the form of a solid ceramic material comprising layers of fire brick and insulation. The hearth may be mounted for rotary movement about its center and may be disposed in an annular enclosure 20. The annular enclosure 20 has a refractory roof 44 and spaced apart inner and outer circular refractory sidewalls 38 and 40, respectively. Optionally the enclosure is sealed by water seals. Such seals (not shown) are well known in the art.

Suitable primary fuel burners 22 (shown in FIG. 2) may be positioned in the vertical inner sidewalls 38, the outer sidewalls 40, or both. The burners 22 may be supplied with any suitable fuel, such gas and combustion air. The burners 22 may be operably fired to provide a controlled temperature and gas composition within the rotary hearth furnace 10. The burners 22 heat the roof 44 and sidewalls 38, 40, so that the furnace 10 radiates heat. In this way, the briquettes 18 on the rotary hearth 42 are heated primarily by radiant heating.

The combustion air for the primary burners 22 may be enriched with oxygen. The oxygen enrichment may allow the primary fuel burners 22 to burn at a higher temperature to increase emissivity while eliminating some or all of the nitrogen component of the air that is supplied with conventional rotary hearth furnaces. The reduction or elimination of the amount of nitrogen being introduced into the furnace results in a reduction of the mass introduced into the furnace, and therefore the amount of turbulence in the furnace 10. Although the combustion air may be replaced with oxygen, too much oxygen enrichment may cause the burners 22 to burn too hot for the refractory material. In one embodiment a mixture of about 60% combustion air and about 40% supplemental oxygen may be a suitable mixture of combustion air and oxygen to heat the furnace 10 at a higher temperature with reduced mass and reduced turbulence and without burning too hot for the refractory material. Other combinations of combustion air and oxygen can be used.

The rotary hearth furnace 10 may be divided into a plurality of zones including for example zones 26, 28, 30 and 32. In addition, there is a loading and discharge space 33 between first zone 26 and final zone 32. It is to be understood that in different furnaces there may be more or less than four heating zones. Positioned in the loading and discharge space 33 is a loading mechanism or feeder 21 for distributing briquettes 18 onto the rotating hearth 42. The briquettes 18 may be uniformly loaded by the feeder 21 onto the furnace hearth 42 through one or more openings, not shown, in the enclosure 20 of the furnace 10. Such feeders are well known in the art. Optionally, the feeder 21 could be placed in the first zone 26. Also, a discharge mechanism, such as a discharge screw 43, is positioned in the loading and discharge space 33 to remove the briquettes 18 from the rotary hearth 42. This could also be placed in the final zone 32 if desired. Discharge screws of the type suitable for use in a rotary hearth furnace are well known.

Optionally, the briquettes 18 are uniformly distributed onto the hearth 42 to form a layer of briquettes. By forming a layer of briquettes 18 having a mean layer depth no more than about one briquette high, rapid heating of the briquettes may be promoted by exposing surfaces of the briquettes to radiant heat transfer from the roof 44 and walls 38, 40 of the enclosure 20.

In the embodiment shown zone 26 is heated to a temperature of about 1100° C., while zones 28, 30 and 32 are maintained at a temperature of about 1350° C. In other embodiments, the operational temperatures for the various zones may be different. During the heating of the briquettes 18, the reduction process will drive off or off-gas some of the carbon in the briquettes. Typically this carbon will be in the form of carbon monoxide. It is possible that other volatiles will also be off-gassed. Exfoliation may also be present, thereby producing particulate matter that can become entrained in the atmosphere in the enclosure 20.

Figure 2:
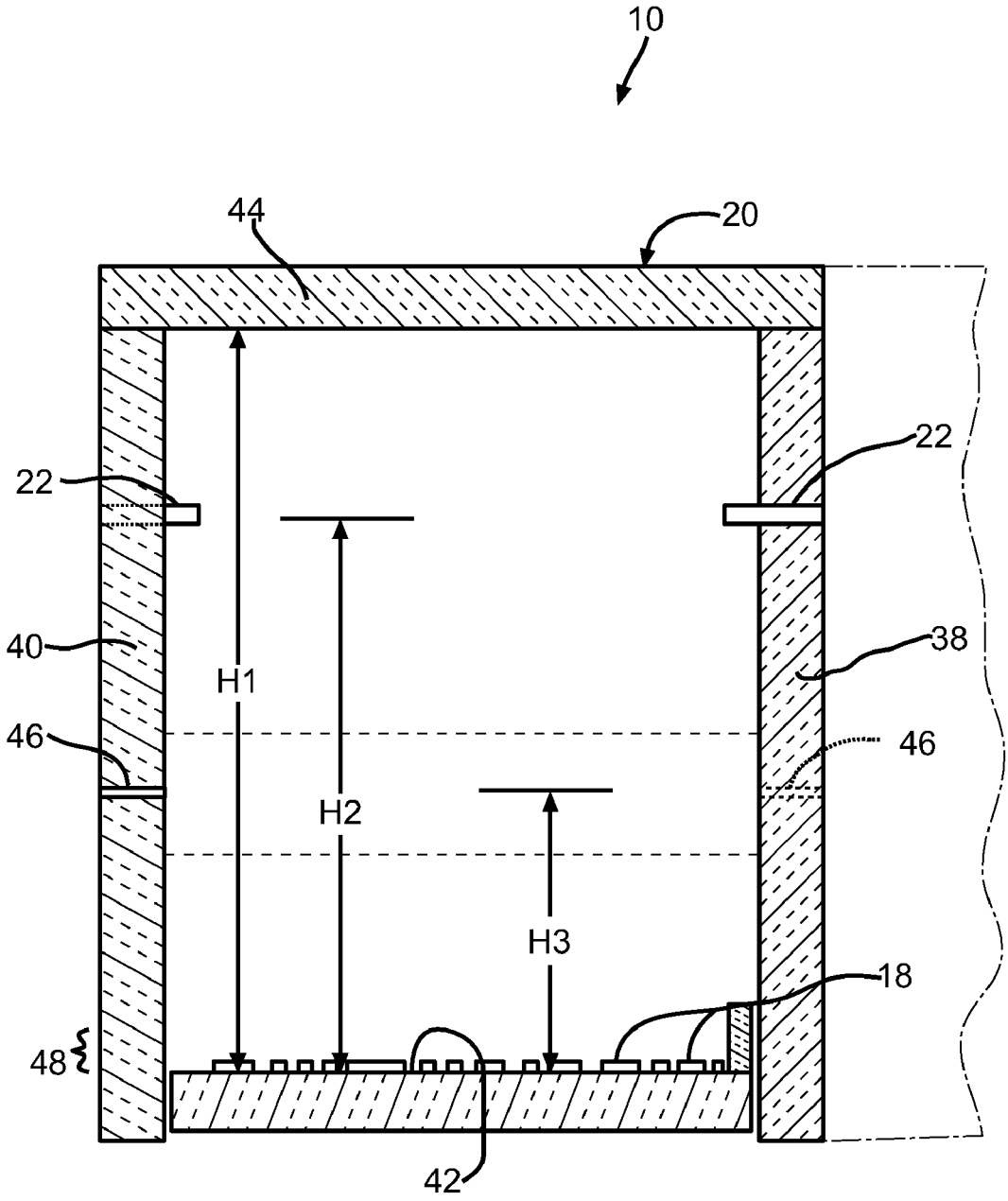
FIG. 2 is a sectional view of the furnace taken along line 2-2 in FIG. 1.

As will become apparent in the description that follows, a supply of oxygen may be introduced to the zones of the rotary hearth furnace to combust the volatile matter and excess carbon monoxide released from the briquettes 18 during the heating process. The oxygen can be supplied into the furnace 10 by the use of nozzles 46. As used in this specification, the term "nozzles" includes any suitable delivery device positioned so that oxygen flowing from the nozzles can be delivered into the interior of the enclosure 20. The oxygen is delivered into a position or location where it can combine with gases, such as carbon dioxide and volatiles, evolving from the heated metal oxide material. The nozzles may be conduits positioned through the walls 38, 40 of the enclosure in the briquettes 18. The nozzles 46 may optionally extend substantially into the interior of the enclosure. Alternatively, as shown in FIG. 2, the nozzles can be configured so that they extend just thorough the interior and exterior side walls 38, 40. The combustion of the volatile matter and carbon monoxide forms carbon dioxide, and releases heat which helps maintain the desired zone temperatures. At the temperature range at which the rotary hearth furnace 10 is operated (approximately 1100° C. to about 1450° C.), the carbon contained within the briquettes 18 will react with the oxygen in the oxides, thereby reducing the metal oxides. The result of this reduction reaction is a residue of the metals and an off-gassing of carbon monoxide. The briquettes 18 may be reduced in the rotary hearth furnace 10 for any suitable time, such as, for example, about 5-20 minutes at a temperature of about 1100-1450° C. The reduced briquettes 18 may be then discharged from the loading and discharge space 33 by a helical screw 23.

Gases in the furnace 10 may be exhausted from flue 36 to provide counter flow from the final zone 32 of the furnace and co-flow from the first zone 26 of the furnace 10. It should be appreciated that by providing counter flow from the final zone 32 of the furnace and co-flow from the first zone 26 of the furnace 10, the final zone 26 and the first zone 32 may be maintained at a pressure equal to atmospheric pressure to preclude furnace gases escaping through the loading or discharge mechanism in a positive pressure situation, and to preclude unwanted air from entering the furnace 10 in a negative pressure situation.

As shown in FIG. 1, in one embodiment, the width of the hearth 42 between the inner and outer walls 38, 40 is within the range of from about 14 to about 24 feet. Any width can be used. Although any suitable number of primary fuel burners 22 may be arranged in any suitable manner, there are illustrated ten primary burners 22 per zone. Five primary fuel burners 22 per zone are equally spaced along the inner refractory wall 38 and five burners 22 per zone are equally spaced along the outer refractory wall 40. It should be appreciated that a greater number of relatively small burners 22 may be more suitable than fewer relatively large burners 22 because the smaller burners 22 may produce less turbulence in the furnace 10. The primary fuel burners 22 can be all on the interior wall 38, all on the exterior wall 40, or on both walls, as shown.

As shown in FIG. 2 the refractory roof 44 is positioned substantially above the level of the rotary hearth 42. In a conventional rotary hearth furnace, the refractory roof is typically 4 feet (1.2 m) above the rotary hearth 42. In the embodiment shown in FIG. 2, however, the roof 44 is positioned at a level that is above the height of a conventional refractory roof for a rotary hearth furnace. The primary fuel burners 22 are positioned in the upper half of the furnace 10, well spaced apart from the briquettes 18. The oxygen nozzles 46 are positioned in the lower half of the furnace 10. Although any suitable number of nozzles 46 may be arranged in any suitable manner, there are preferably the same number of nozzles 46 as there are fuel burners 22, that is a total of ten nozzles 46 per zone, five nozzles 46 per zone equally spaced along the inner refractory wall 38 and five nozzles 46 per zone equally spaced along the outer refractory wall 40. It is to be understood that all the oxygen nozzles 46 can be placed through the inner wall 38, or all the oxygen nozzles can be placed through the outer wall 40, but in the embodiment shown, there are equal numbers of nozzles in the inner wall 38 as in the outer wall 40. For purposes of clarity, the oxygen nozzles 46 are shown in the zone 30 only, although there are such nozzles in all the zones. The oxygen is supplied to the nozzles 46 by a supply system, not shown. As shown in FIG. 2, the oxygen nozzles 46 are circumferentially staggered so that they are not radially aligned. Other arrangements of the nozzles are possible.

The primary fuel burners 22 are positioned so that radiant heat is transferred to the briquettes 18, but the burners are also positioned to minimize turbulence near the briquettes 18. Reducing turbulence near the briquettes 18 will reduce the entrainment of dust from the briquettes 18. The presence of dust and particulate matter interferes with radiant heat transfer from the enclosure walls 38, 40 and from the enclosure roof 44. As shown in FIG. 2, the oxygen nozzles 46 are positioned to produce a quiescent zone 48 (e.g., a stable blanket) between the primary fuel burners 22 and the briquettes 18. The quiescent zone 48 may block turbulence generated by the fuel burners 22, and further may reduce the entrainment of dust from the briquettes 18. Introducing oxygen into the enclosure 20 by means of the oxygen nozzles 46 enables the consumption (by combustion) of the carbon monoxide emitted or off-gassed from the briquettes 18. The height of the quiescent zone 48 above the hearth 42 can be any suitable height sufficient to block or minimize entrainment of particulate material and to prevent oxygen from reaching the briquettes 18, which would lead to re-oxidation of the briquettes. In one embodiment the height of the quiescent zone is within the range of from about 2 to about 3 inches (about 5 to about 7.5 cm) above the average height of the briquettes 18.

The height H1 of the refractory roof 44 from the hearth 42 is preferably about eight feet (2.4 m), although the roof 44 may be at other heights, including heights ranging from about five feet (1.53 m) to about ten feet (3.05 m). The height H2 of the fuel burners 22 may be about six feet (1.83 m) from the rotating hearth 42, although any height within the range of from about four feet (1.2 m) to about ten feet (3.05 m) can be used. The height of the oxygen nozzles 46 in the embodiment shown in FIG. 2 is about two feet (0.61 m), but may be within the range of from about one foot (0.31 m) to about three feet (0.92 m) from the rotating hearth 42.

The furnace 10 may address a number of challenges that are encountered in reducing metallic oxide material in the furnace 10. One challenge is maintaining a relatively constant time versus temperature exposure of the metallic oxides to the heat source. A relatively uniform reduction of metallic oxide may be achieved by a relatively uniform exposure of the metallic oxide material to the heating source over a given time. An even distribution of briquettes 18 onto the rotary hearth 42 may provide a superior reduction metallic oxide material. The depth of briquettes 18 loaded onto the rotary hearth 42 should be as uniform as possible. A layer of briquettes 18 having a mean layer depth no more than about one briquette high may result in a relatively uniform exposure of the metallic oxide material and thus provide a superior reduction of the metallic oxide material.

Uniformity in the reduction of the metal oxides can also be facilitated by maintaining uniformity in size and shape of the briquettes 18. The briquettes 18 may be sized within the range of from about 0.5 inches (13 mm) to about 2.5 inches (6.2 mm), preferably having a thickness of about 0.5 inches (13 mm) to about 1.5 inches (37.5 mm), a width of about 0.5 inches (13 mm) to about 1.5 inches (37 mm), and a length of about 1.5 inches (37 mm) to about 2.0 inches (50 mm). Alternatively other shapes of agglomerates can also be used, such as, for example, bricks, pellets or additional suitable shapes.

Another challenge in operation of a rotary hearth furnace is to burn the carbon monoxide off-gassed without increasing the mass and turbulence in the furnace 10. Increased turbulence in the furnace 10 can cause oxygen within the furnace 10 to contact the metal oxide material and re-oxidize it. It is especially important to avoid re-oxidation of the reduced briquettes 18 in the later zones of the furnace 10, i.e., zones 30 and 32. Turbulence in the furnace 10 can also entrain dust from the briquettes 18. The presence of dust within the furnace 10 can interfere with radiant heat transfer within the furnace 10 from the heated refractory walls 38, 40 and heated refractory roof 44 to the briquettes 18, resulting in inefficient treatment of the briquettes 18. In addition to the deterioration in radiative heat transfer occasioned by the entrainment of particulate matter, the entrained particulate matter may possibly coat the refractory walls 38, 40 and roof 44, thereby further interfering with radiant heat transfer between the refractory walls 38, 40 and the briquettes 18. Particulate matter can be further minimized by loading the briquettes 18 into the first loading zone 26 having a lower relative temperature (e.g., about 1100° C.) than the temperature of the other zones. This can result in reduced exfoliation (i.e., the creation of dust or particulate matter by exposing the briquettes 18 to a high temperature).

As explained above, the introduction of oxygen at a height above the forehearth that is sufficiently spaced above the briquettes 18 and at a desired flow rate to establish a stable quiescent zone spaced above the briquettes 18, can protect the briquettes 18 from turbulence in the furnace 10 and minimize dust within the furnace 10. The oxygen nozzles 46 are positioned high enough above the rotary hearth 42 to avoid substantial contact between the oxygen and the metal oxide material in the briquettes 18, thereby creating a quiescent zone 48 immediately above the metal oxide material, with the quiescent zone 48 being sufficient to minimize entrainment of particulate matter from the metal oxide material.

It should be appreciated that the fuel burners 22 may be above the hearth 42 a distance more than half way between the hearth 42 and the refractory roof 44 (e.g., greater than 50% of the total height of the furnace 10). In the illustrated embodiment, the refractory roof 44 is eight feet high and the burners 22 are six feet above the hearth 42, or about ¾ or about 75% of the distance between the hearth 42 and the roof 44 above the furnace 10. In addition to the roof's 44 being at a sufficient distance above the hearth 42 and the primary burners 22 being spaced sufficiently away from the briquettes 18, the oxygen nozzles 46 are positioned in the furnace 10 at some point between the hearth 42 and the burners 22 to allow the combusted products to heat the roof and walls and not disturb the quiescent zone 48. This distance is sufficiently high above the briquettes 18 so that to avoid substantial contact between the oxygen and the metal oxide material, thereby creating the quiescent zone immediately above the metal oxide material, with the quiescent zone being sufficient to minimize entrainment of particulate matter from the metal oxide material. Further, because the oxygen does not flow into contact with the briquettes 18, there is an elimination or substantial reduction in the amount of re-oxidation of the treated (reduced) material in the briquettes 18. In the illustrated embodiment, the nozzles 46 may be positioned in a range from about 2 to 3 feet above the hearth 42 (e.g., greater than about 25% of the total height of the furnace 10). The introduction of oxygen from the nozzles 46 is handled in a manner that enables the creation of the quiescent zone 48 that blocks turbulent flow from the primary fuel burners 22 from reaching the briquettes, or at least reduces the amount of turbulent flow reaching the briquettes, while reducing the risk that oxygen will flow into contact with the briquettes 18 resulting in the re-oxidization of the briquettes.

In another embodiment, the oxygen nozzles emit oxygen at a pressure sufficiently low to ensure combustion of the evolved gases without generating turbulence contacting the metal oxide material, thereby enabling a quiescent zone to be maintained immediately above the metal oxide material. It is to be understood that the nozzles 46 do not have to be horizontal, and can be positioned at an acute angle to the horizontal to produce the desired flow pattern for the best establishment of the quiescent zone 48. Also, the nozzles 46 can be positioned at an angle to the inner and outer sidewalls 38, 40 that is other than 90 degrees.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A rotary hearth furnace for treating metal oxide materials comprising:

an annular enclosure having a roof and spaced apart inner and outer circular sidewalls;

an annular hearth for supporting metal oxide materials to be treated, the hearth being mounted for rotary movement within the enclosure, the enclosure and the hearth being formed of a refractory material;

one or more primary fuel burners positioned above the hearth, the burners having a discharge end positioned within the enclosure, the burners being capable of being fired to discharge combusted gases into the furnace, thereby heating the furnace walls, roof and hearth, whereby the furnace walls and roof are capable of radiating heat to the metal oxide materials on the hearth; and one or more oxygen nozzles positioned above the hearth, where the oxygen nozzles are connected to a supply of oxygen, the oxygen nozzles having a discharge end within the enclosure so that oxygen flowing from the nozzles combines with gases evolving from the metal oxide material, where the oxygen nozzles are positioned high enough above the hearth to avoid substantial contact between the oxygen and the metal oxide material, thereby creating a quiescent zone immediately above the metal oxide material, with the quiescent zone being sufficient to minimize entrainment of particulate matter from the metal oxide material.

2. The furnace of claim 1 wherein the primary fuel burners and the oxygen nozzles are each provided along the inner and outer sidewalls.

3. The furnace of claim 1 wherein within each zone the number of primary fuel burners on the inner sidewall equals the number of primary fuel burners on the outside sidewall.

4. The furnace of claim 1 wherein the primary fuel burners are positioned in an upper half of the furnace and the oxygen nozzles are positioned in a lower half of the furnace.

5. The furnace of claim 1 wherein the roof is spaced above the hearth a distance in a range from about five feet (1.53 m) to about ten feet (3.05 m).

6. A rotary hearth furnace for treating metal oxide materials comprising:

an annular enclosure having a roof and spaced apart inner and outer circular sidewalls;

an annular hearth for supporting metal oxide materials to be treated, the hearth being mounted for rotary movement within the enclosure, the enclosure and the hearth being formed of a refractory material, the roof of the enclosure being positioned at a first height above the hearth;

one or more primary fuel burners positioned at a second height above the hearth, wherein the second height is below the first height, the burners being capable of being fired to discharge combusted gases into the furnace, thereby heating the furnace walls, roof and hearth, whereby the furnace walls and roof are capable of radiating heat to the metal oxide materials on the hearth; and one or more oxygen nozzles positioned at a third height above the hearth wherein the third height is below the second height, the nozzles being positioned so that oxygen flowing from the nozzles combines with gases evolving from the metal oxide material, where the oxygen nozzles are positioned high enough above the hearth to avoid substantial contact between the oxygen and the metal oxide material, thereby creating a quiescent zone immediately above the metal oxide material, with the quiescent zone being sufficient to minimize entrainment of particulate matter from the metal oxide material.

7. The furnace of claim 6 further including a supply of combustion air to the primary fuel burners, where the combustion air is enriched with oxygen to allow the primary fuel burners to burn at a higher temperature with reduced turbulence in the furnace.

8. The furnace of claim 6 wherein the primary fuel burners and the oxygen nozzles are each provided along the inner and outer sidewalls.

9. The furnace of claim 6 wherein within each zone the fuel burners and the oxygen nozzles are equal in number.

10. The furnace of claim 6 wherein within each zone the number of primary fuel burners on the inner sidewall equals the number of primary fuel burners on the outside sidewall.

11. The furnace of claim 6 wherein the primary fuel burners are positioned in an upper half of the furnace and the oxygen nozzles are positioned in a lower half of the furnace.

12. The furnace of claim 6 wherein the roof is at a height of about eight feet (2.44 m) from the hearth, the fuel burners are at a height of about six feet (1.83 m) from the hearth, and the oxygen nozzles are at a height in a range from about two feet (0.61 m) to about three feet (0.92 m) from the hearth.

13. A rotary hearth furnace for treating metal oxide materials comprising:

an annular enclosure having inner and outer circular sidewalls;

an annular hearth for supporting metal oxide materials to be treated, the hearth being mounted for rotary movement within the enclosure, the enclosure and the hearth being formed of a refractory material, the enclosure comprising a roof positioned at a first height above the hearth;

one or more primary fuel burners positioned at a second height above the hearth, wherein the second height is below the first height, the burners being capable of being fired to discharge combusted gases into the furnace, thereby heating the furnace walls, roof and hearth, whereby the furnace walls and roof are capable of radiating heat to the metal oxide materials on the hearth; and one or more oxygen nozzles positioned at a third height above the hearth wherein the third height is below the second height, the nozzles being positioned so that oxygen flowing from the nozzles combines with gases evolving from the metal oxide material, where the oxygen nozzles emit oxygen at a pressure sufficiently low to ensure substantial combustion of the evolved gases without generating turbulence contacting the metal oxide material, thereby enabling a quiescent zone to be maintained immediately above the metal oxide material.

14. The furnace of claim 13 further including a supply of combustion air to the primary fuel burners, where the combustion air is enriched with oxygen to allow the primary fuel burners to burn at a higher temperature with reduced turbulence in the furnace.

15. The furnace of claim 13 wherein the primary fuel burners and the oxygen nozzles are each provided along the inner and outer sidewalls.

16. The furnace of claim 13 wherein the roof is spaced above the hearth a distance in a range from about five feet (1.53 m) to about ten feet (3.05 m).

17. The furnace of claim 13 wherein within each zone the fuel burners and the oxygen nozzles are equal in number.

18. The furnace of claim 13 wherein within each zone the number of primary fuel burners on the inner sidewall equals the number of primary fuel burners on the outside sidewall.

19. The furnace of claim 13 wherein the primary fuel burners are positioned in an upper half of the furnace and the oxygen nozzles are positioned in a lower half of the furnace.

20. The furnace of claim 13 wherein the roof is at a height of about eight feet (2.44 m) from the hearth, the fuel burners are at a height of about six feet (1.83 m) from the hearth, and the oxygen nozzles are at a height in a range from about two feet (0.61 m) to about three feet (0.92 m) from the hearth.

21. A rotary hearth furnace for treating metal oxide materials comprising primary fuel burners positioned in an upper half of the furnace and oxygen nozzles positioned in a lower half of the furnace one or more oxygen nozzles positioned above the hearth, where the oxygen nozzles are connected to a supply of oxygen, the oxygen nozzles having a discharge end within the enclosure so that oxygen flowing from the nozzles combines with gases evolving from the metal oxide material, where the oxygen nozzles are positioned high enough above the hearth to avoid substantial contact between the oxygen and the metal oxide material, thereby creating a quiescent zone immediately above the metal oxide material, with the quiescent zone being sufficient to minimize entrainment of particulate matter from the metal oxide material.

* * * * *